United States Patent [19]

Baldyga et al.

[11] 3,976,235

[45] Aug. 24, 1976

[54] STOP FEED MECHANISM

[75] Inventors: Joseph W. Baldyga, Mount Clemens; Thomas M. Cairns, Birmingham, both of Mich.

[73] Assignee: Diamond Die & Mold Co., Mount Clemens, Mich.

[22] Filed: Mar. 28, 1975

[21] Appl. No.: 563,189

[52] U.S. Cl. ..... 226/11; 226/75; 226/161

[51] Int. Cl.[2] ..... B65H 25/00

[58] Field of Search ..... 226/6, 11, 62, 59, 66, 226/67, 68, 74, 75, 161

[56] References Cited

UNITED STATES PATENTS 2,085,590 6/1937 Jones ..... 226/11

3,477,627 11/1969 Webers ..... 226/161 X

*Primary Examiner*—Richard A. Schacher

*Attorney, Agent, or Firm*—Whittemore, Hulbert & Belknap

[57] ABSTRACT

Stop feed mechanism for feeding continuous stock having uniformly spaced abutments thereon in which a resiliently biased dog is moved rearwardly over an abutment and then is moved forwardly in a feeding stroke in which it engages the abutment. Means are provided for sensing when the supply of continuous stock is nearly exhausted and for interrupting further feed by blocking engagement of the dog with an abutment during the feeding stroke.

10 Claims, 4 Drawing Figures

STOP FEED MECHANISM

BRIEF SUMMARY OF THE INVENTION

The present invention is applicable to many different types of feeding devices but has particular application to devices for feeding terminal stock into a machine for crimping terminals around the ends of bared conductors. The stock for forming terminals comprises a continuous metal strip from which portions have been cut to leave a series of terminal forming portions spaced uniformly therealong. In one case the terminal forming portions extend between two continuous strip portions at opposite sides of the terminal stock. In another case the terminal forming portions extend laterally from a single continuous strip.

Where the terminal forming portions are located between two continuous strips, it is possible for the feed dog to engage terminal forming portions directly since the two continuous strips at opposite ends of the terminal forming portions reinforce them sufficiently so that they may withstand the force required to advance the terminal stock. However, when the terminal forming portions extend laterally from a single strip, other abutment means must be provided and in the present case it is provided by a conveyor having a multiplicity of pins extending from opposite sides of the conveyor. At one side the pins are designed to enter into openings in the continuous strip, and at the other side of the conveyor the pins extend to provide a correspondingly spaced series of abutments.

The feeding means may be generally of the type illustrated in prior U.S. Pat. No. 3,578,230 wherein a feed dog is shown as pivotally connected to a reciprocating carriage, movements of which are suitably coordinated with movements of the terminal crimping punch and die.

In the present case, means sensing approach of the end of the terminal stock is provided, and as illustrated herein, takes the form of a spring pressed roller mounted on one end of a pivoted lever, the roller being engageable with an edge of the continuous strip of material. When the end of strip material passes the roller, the lever is pivoted and a flat obstruction is inserted in the path of the feed dog so that on successive forward or feeding strokes thereof the dog repeatedly moves idly over an abutment, thus terminating incremental advance of the strip.

It will be understood that in many cases the operation involves automatic feeding of the ends of electrical conductors into position in the die to receive the terminal in crimped relation upon operation of a press actuating the die. Absence of a terminal forming portion may lead to damage of the expensive punch and/or die elements, or other parts of the apparatus.

DETAILED DESCRIPTION

Figure 1:
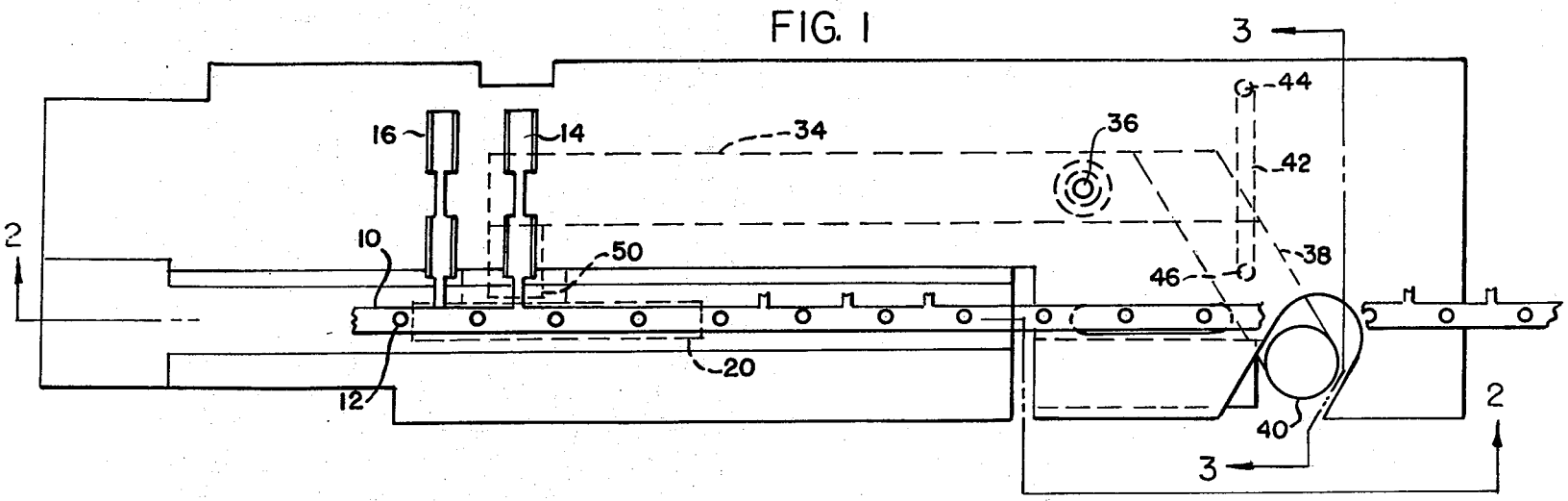
FIG. 1 is a more or less diagrammatic plan view of a strip feeder.
Figure 3:
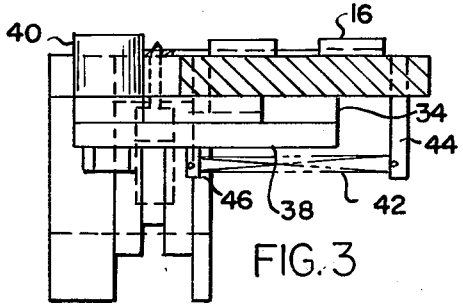
FIG. 3 is a section on the line 3—3, FIG. 1.
Figure 2:
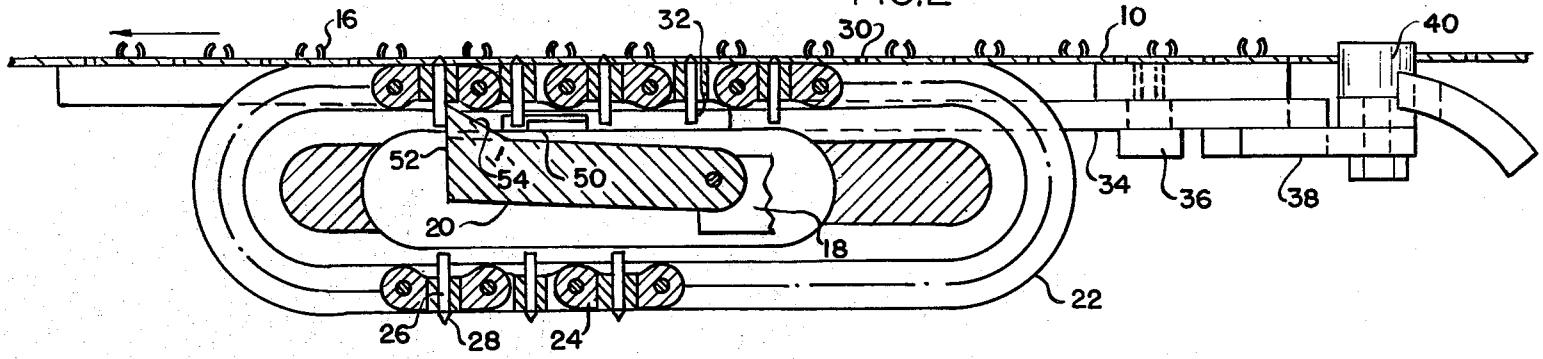
FIG. 2 is a fragmentary section on the line 2—2, FIG. 1.

Referring first to FIGS. 1–3, the feeding mechanism is illustrated as applied to terminal forming stock and comprises a continuous strip 10 having a series of openings 12 formed therein, the strip having extending laterally from one side thereof a series of uniformly spaced terminal forming portions 14 which are illustrated as having upturned edges 16 adapted to be crimped into predetermined relationship to the end of a conductor by a punch and die mechanism (not illustrated herein).

The feeding mechanism comprises a feed slide, a portion of which is indicated at 18, to which a feed dog 20 is pivoted.

Since the terminal forming portions 14 are relatively fragile, it is not practical to feed the terminal forming portions by causing the feed dog to engage the terminal forming portions 14. Accordingly, the feeding is accomplished by providing a continuous conveyor 22 formed of a multiplicity of individual links 24 through which extend pins 26. The pins 26 extend outwardly beyond the conveyor 22 to form feed portions 28 engageable in openings 30 provided in the continuous strip 10. The other ends of the pins 26 extend inwardly of the conveyor and provide a series of feed abutment portions 32 which are engaged by the nose of the feed dog 20 as the feed carriage 18 is reciprocated. Accordingly, the continuous strip 10 provided with the uniformly spaced series of openings 12 is engaged by a multiplicity of pins 26 with the result that the terminal stock may be positively fed as the feed carriage is reciprocated.

It will be understood that the continuous terminal stock is normally provided on a reel so that substantial forces may be necessary to insure positive advance of the terminal stock.

Means are provided for sensing approach of the end of the supply of terminal stock and this means comprises a lever 34 pivoted to the frame of the feed mechanism as indicated at 36. The lever 34 has an arm 38 extending therefrom, the arm carrying a roller 40 which engages an edge of the continuous strip 10. A tension spring 42 is connected between a pin 44 and a pin 46 carried by the arm 38.

At the opposite end of the lever 34 there is a laterally projecting obstruction plate 50. When the roller 40 engages an edge of the strip 10, the obstruction plate 50 is retained in laterally spaced relation from the feed dog 20, as best illustrated in FIG. 1. However, when the end of the strip 10 passes the roller 40 the spring 42 causes the lever 34 to rotate counterclockwise as seen in FIG. 1, and the obstruction plate 50 is inserted into the path of movement of the nose of the feed dog as best illustrted in FIG. 2.

The nose of the feed dog includes a feeding surface 52 normally engageable with a feed abutment formed by the inner end of one of the pins 26, and a camming surface 54 which causes the feed dog to be pivoted against resilient biasing means (not shown) so that it passes to the right of the next feeding abutment 32. When the obstruction plate 50 is inserted in line with the pins 26, the pointed nose of the feed dog rides up onto the obstruction plate on the idle or return stroke and is prevented from engaging with the feeding abutment on the next forward stroke.

Figure 4:
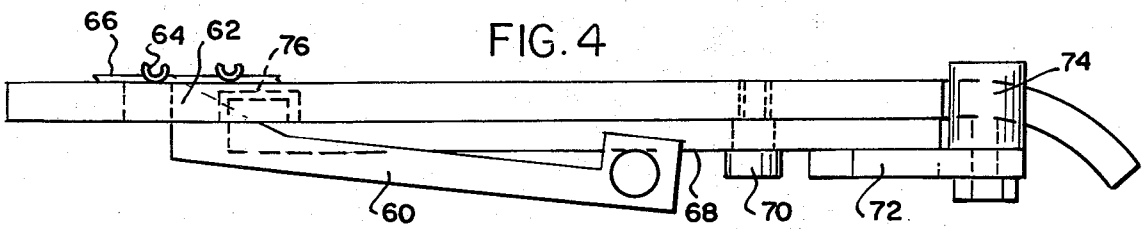
FIG. 4 is a more or less diagrammatic view of a modification of the invention.

Referring now to FIG. 4 there is illustrated a generally equivalent construction except that in this case the feed dog, here designated 60, is positioned so that its nose 62 is adapted to engage a terminal forming portion 64, which in this instance extends between two parallel continuous feed strips 66, so that the terminal forming portions of the terminal stock are adequately supported for coaction with the feed dog 60.

In this construction, a lever 68 pivoted as indicated at 70, is provided with an arm 72 carrying a roller 74 which engages an edge of one of the continuous strips 66. Lever 68 carries an obstruction plate 76, which in this instance is adapted to be moved beneath one of the terminal forming portions 64 so as to discontinue further feeding movement when the lever 68 is permitted to swing by movement of the end of the strip 66 past the roller 74.

As seen in FIG. 4, the obstruction plate 76 overlies the terminal forming portion of the terminal stock which would normally be next engaged by the nose 62 of the spring biased feed dog 60. Accordingly, the feed dog 60 is cammed downwardly as the feed dog is moved on its idle or return stroke to the right, and is prevented by the obstruction plate 76 from engaging the next terminal forming portion 64.

What we claim as our invention is:

1. Feed mechanism for feeding continuous strip material in successive increments comprising an elongated carrier having means for connecting said carrier to the strip material for movement therewith, a series of uniformly spaced feed abutments provided by said elongated carrier, a feed member, means for moving said feed member in alternate feed and return strokes along said series of abutments, said member having a feed portion movable in a direction transverse to its direction of movement in said feed and return strokes relative to said series of abutments, resilient means urging the feed portion of said member toward said series of abutments, the feed portion of said feed member having a cam surface thereon engageable with one of said abutments during the return stroke of said member shaped to cam the feed portion of said member to pass over said one abutment, said feed portion having a feed surface engageable with said one abutment on the successive feed stroke of said member to move said one abutment and hence the strip material forwardly a distance equal to the spacing between said abutments during the feed stroke of said member, and feed control means responsive to the movement of the trailing end of said strip material therebeyond operatively associated with said feed member to prevent engagement of the feed portion of said feed member with an abutment on successive feed strokes.

2. Mechanism as defined in claim 1 in which said carrier is in the form of an endless conveyor having a straight portion movable with a straight portion of the strip material.

3. Mechanism as defined in claim 1, said feed control means comprising a movable control member having a portion engageable with the strip and retained thereby in fixed position, means biasing the portion of said control member against the strip and being effective to move said control member when the end of the strip material passes said portion thereof.

4. Mechanism as defined in claim 3, said control member having a blocking portion movable into a blocking position to prevent engagement between the feed surface of the feed portion of said feed member with an abutment on the feed stroke thereof.

5. Mechanism as defined in claim 4 in which said blocking portion is a flat element movable into a blocking position in which it overlies the abutment otherwise engageable by said feed member on its feed stroke.

6. Mechanism as defined in claim 2, said carrier having a series of spaced pins extending therethrough and beyond opposite sides thereof, the portions of said pins at one side being receivable in spaced openings in the strip material and the portions of said pins projecting beyond the other side of said conveyor constituting the aforesaid feed abutments.

7. Mechanism as defined in claim 6, said feed control means comprising a movable control member having a portion engageable with the strip and retained thereby in fixed position, means biasing the portion of said control member against the strip and being effective to move said control member when the end of the strip material passes said portion thereof.

8. Mechanism as defined in claim 7, said control member having a blocking portion movable into a blocking position to prevent engagement between the feed surface of the feed portion of said feed member with an abutment on the feed stroke thereof.

9. Mechanism as defined in claim 8 in which said blocking portion is a flat element movable into a blocking position in which it overlies the abutment otherwise engageable by said feed member on its feed stroke.

10. Feed mechanism for feeding continuous strip material having a series of uniformly longitudinally spaced abutments thereon in successive increments comprising an endless carrier having a portion movable with said strip material, said carrier having a first series of longitudinally uniformly spaced strip feeding abutments, a plurality of which are engageable simultaneously with a plurality of abutments on the strip material, said carrier having a second series of longitudinally uniformly spaced carrier feeding abutments, a feed member, means for moving said feed member in alternate and return strokes along the series of carrier feeding abutments on said carrier, said member having a feed portion movable in a direction transverse to its direction of movement in said feed and return strokes relative to said carrier, resilient means urging the feed portion of said member toward said carrier, the feed portion of said feed member having a cam surface thereon engageable with one of said carrier feeding abutments during the return stroke of said member shaped to cam the feed portion of said member to pass over said one abutment, said feed portion having a feed surface engageable with said one abutment on the successive feed stroke of said member to move said one abutment and hence the carrier and strip material forwardly a distance equal to the spacing between said carrier feeding abutments during the feed stroke of said member, and feed control means responsive to movement of the trailing end of the strip material therebeyond operatively associated with said feed member to prevent engagement of the feed portion of said feed member with a carrier feeding abutment on successive feed strokes, said feed control means comprising a movable control member having a portion engageable with the strip and retained thereby in fixed position, means biasing the portion of said control member against the strip and being effective to move said control member when the end of the strip material passes said portion thereof, said control member having a blocking portion movable into a blocking position between said feed portion of said feed member and the adjacent carrier feeding abutment on said endless carrier to prevent engagement between the feed surface of the feed portion of said feed member with a carrier feeding abutment on the feed stroke of said feed member.

* * * * *